US011460258B2

(12) United States Patent
Brumfield

(10) Patent No.: US 11,460,258 B2
(45) Date of Patent: Oct. 4, 2022

(54) SYSTEM FOR CLEANING AN OBJECT SUCH AS A HEAT EXCHANGER

(71) Applicant: Peinemann Equipment B.V., Hoogvilet-Rotterdam (NL)

(72) Inventor: Michael Kenneth Brumfield, Bridge City, TX (US)

(73) Assignee: PEINEMANN EQUIPMENT B.V.

( * ) Notice: Subject to any disclaimer, the term of this patent is extended or adjusted under 35 U.S.C. 154(b) by 0 days.

(21) Appl. No.: 15/145,226

(22) Filed: May 3, 2016

(65) Prior Publication Data

US 2017/0108300 A1 Apr. 20, 2017

Related U.S. Application Data

(60) Provisional application No. 62/242,506, filed on Oct. 16, 2015.

(51) Int. Cl.
*F28G 15/02* (2006.01)
*B08B 3/02* (2006.01)
(Continued)

(52) U.S. Cl.
CPC ..... *F28G 15/02* (2013.01); *B08B 3/024* (2013.01); *B08B 9/0325* (2013.01); *F28G 1/163* (2013.01);
(Continued)

(58) Field of Classification Search
CPC ..... B08B 3/024; B08B 9/027; B08B 9/04; B08B 9/0323; F28G 9/00; F28G 3/163; F28G 3/166; F28G 15/04; F28G 1/163
See application file for complete search history.

(56) References Cited

U.S. PATENT DOCUMENTS 3,794,051 A 2/1974 Lee et al.
3,821,498 A * 6/1974 Schaefer ..... B25J 9/041 200/18
(Continued)

FOREIGN PATENT DOCUMENTS

CN 100500308 C * 6/2009
CN 100500308 C 6/2009
(Continued)

OTHER PUBLICATIONS

WJTA-IMCA Expo Live Demos—Peinemann Equipment (https://www.youtube.com/watch?v=ORI-jX6Zh7o, dated Oct. 9, 2012) (relevant time 6:30 to 9:10). (Year: 2012).*
(Continued)

*Primary Examiner* — Joseph L. Perrin
*Assistant Examiner* — Kevin G Lee
(74) *Attorney, Agent, or Firm* — Sand, Sebolt & Wernow Co., LPA

(57) ABSTRACT

A system is disclosed for cleaning an object, such as a heat exchanger including a bundle of feed-through tubes extending between two end plates. In an embodiment, the system includes a connection body for connecting the system to an object, a holder for holding a cleaning device and a moving system for moving the holder with respect to the connection body in a first direction and a second direction at least having a component perpendicular to the first direction. The moving system includes a rotation motor and a linear motor.

20 Claims, 7 Drawing Sheets

(51) Int. Cl.

| | |
|---|---|
| ***B08B 9/032*** | (2006.01) |
| ***F28G 15/04*** | (2006.01) |
| ***F28G 1/16*** | (2006.01) |
| *F28D 21/00* | (2006.01) |
| *F28G 9/00* | (2006.01) |
| *F28G 15/00* | (2006.01) |

(52) U.S. Cl.
CPC ..... *F28G 15/04* (2013.01); *F28D 2021/0059* (2013.01); *F28G 9/00* (2013.01); *F28G 15/003* (2013.01)

(56) References Cited

U.S. PATENT DOCUMENTS

| | | | | |
|---|---|---|---|---|
| 3,901,252 | A | 8/1975 | Riebe | |
| 3,903,912 | A | 9/1975 | Ice, Jr. et al. | |
| 4,001,556 | A * | 1/1977 | Folchi | B25J 13/081 700/258 |
| 4,229,136 | A * | 10/1980 | Panissidi | B25J 19/0012 414/673 |
| 4,367,790 | A * | 1/1983 | Draeger | F28G 15/04 165/11.1 |
| 4,437,201 | A | 3/1984 | Zalewski | |
| 4,527,515 | A | 7/1985 | Hester, II | |
| 4,716,611 | A | 1/1988 | Barry | |
| 4,773,357 | A | 9/1988 | Scharton et al. | |
| 5,570,660 | A | 11/1996 | Vandenberg | |
| 5,838,882 | A * | 11/1998 | Gan | B25J 9/1694 700/259 |
| 6,681,839 | B1 | 1/2004 | Balzer | |
| 8,308,869 | B2 | 11/2012 | Gardner | |
| 8,524,011 | B2 | 9/2013 | Gardner | |
| 8,646,416 | B2 | 2/2014 | Hawkins et al. | |
| 9,605,915 | B2 * | 3/2017 | Crock | F28G 1/16 |
| 10,514,217 | B2 | 12/2019 | Wall et al. | |
| 2004/0069331 | A1 | 4/2004 | Garman et al. | |
| 2008/0185126 | A1 * | 8/2008 | Jiang | F28B 11/00 165/95 |
| 2012/0024321 | A1 | 2/2012 | Hays | |
| 2012/0067370 | A1 | 3/2012 | Crock et al. | |
| 2015/0034128 | A1 * | 2/2015 | Brumfield | B08B 9/0433 134/22.11 |
| 2015/0068563 | A1 * | 3/2015 | Gzym | F28G 15/04 134/168 C |
| 2015/0258694 | A1 | 9/2015 | Hand et al. | |
| 2016/0025433 | A1 * | 1/2016 | Mathis | F28G 15/02 269/1 |
| 2016/0243597 | A1 * | 8/2016 | Shawver | F28G 15/02 |
| 2017/0102195 | A1 | 4/2017 | Watkins | |
| 2017/0108300 | A1 | 4/2017 | Brumfield | |
| 2017/0348931 | A1 * | 12/2017 | Yuzer | B08B 9/00 |
| 2018/0281030 | A1 | 10/2018 | Eisermann et al. | |

FOREIGN PATENT DOCUMENTS

| | | | |
|---|---|---|---|
| CN | 203250208 | U | 10/2013 |
| CN | 203837569 | U | 9/2014 |
| CN | 104181867 | A | 12/2014 |
| CN | 104440896 | A * | 3/2015 |
| DE | 102014104356 | | 10/2015 |
| EP | 0569080 | | 11/1993 |
| EP | 0569080 | A1 | 11/1993 |
| EP | 0803697 | | 10/1997 |
| EP | 0803697 | A2 | 10/1997 |
| FR | 2563331 | | 10/1985 |
| FR | 2563331 | A1 | 10/1985 |
| WO | 0111303 | | 2/2001 |
| WO | WO-0111303 | A1 | 2/2001 |
| WO | 2016037197 | | 3/2016 |

OTHER PUBLICATIONS

International Search Report and Written Opinion dated Jan. 9, 2017.
Operation Manual Sabertooth Air Powered Dual Hose Reel StoneAge. 2010.
Spong, et al. Robot Dynamics and Control. 2nd Edition p. 9,1.1, pp. 13-22, 1.3.1-1.3.6; Jan. 28, 2004.
Shawver. How Automated Water Jetting Improves Tube Bundle Cleaning Efficiency. 2011 WJTA-IMCA Conference and Expo. Sep. 2011. Houston, TX.
Video Stutes Enterprise Live Demo—2013 WJTA-IMCA Conference & Expo (https://www.youtube.com/watch?v=zoCFoopM yU).
Video Peinemann Equipment Live Demo—2013 WJTA-IMCA Conference & Expo Sep. 11, 2013 (https://www.youtube com/watch ?v=GPa2w65ZNkE).
Video Veolia Diamondback(https://www.youtube.com/watch?v=8tAZwctqneQ); Feb. 13, 2014.
Video StoneAge (https://www.youtube.com/watch?v=g8b4WKX5qzU).
Operation Manual Sabertooth Air Powered Dual Hose Reel StoneAge, StoneAge Waterblast Tools, (Sep. 1, 2010), pp. 1-7, XP055762268.

* cited by examiner

SYSTEM FOR CLEANING AN OBJECT SUCH AS A HEAT EXCHANGER

PRIORITY STATEMENT

The present application hereby claims priority under 35 U.S.C. § 119(e) to U.S. provisional patent application No. 62/242,506 filed Oct. 16, 2015, the entire contents of which are hereby incorporated herein by reference.

FIELD

At least one embodiment of the present invention generally relates to a system for cleaning an object, such as a heat exchanger comprising a bundle of feed-through tubes.

BACKGROUND

In the petrochemical industry, frequent use is made of heat exchangers for the purpose of cooling or heating fluid flows. A common heat exchanger is a tube heat exchanger consisting substantially of a bundle of tubes extending between two end plates or a common end plate enclosed by a casing. In the course of time these tubes become fouled such that the through-flow is blocked or restricted. In order to enable the heat exchanger to function optimally again the tubes are cleaned by injecting liquid under high pressure through these tubes using a high-pressure lance.

These lances are typically in the form of high-pressure hoses which carry a high-pressure injection nozzle on their front end. These hoses are pushed or fed into the heat exchanger pipes. After the high-pressure source for the washing liquid has been set into operation, the dirt is removed from the tube and the hose can herein be pushed further into the tube, until the whole length of the tube is cleaned.

As the lances carry liquid under very high pressure, a cleaning device is typically used to introduce and push the lances into the tubes, such that manual operation of the lances is not required. A suitable cleaning device as such is described in international patent publication WO 01/11303A1. This cleaning device arranged for driving a flexible lance is provided with a frame in which a device for driving a flexible lance is arranged for moving this flexible lance in the direction of an outlet opening. This cleaning device is operated by manually aligning the outlet opening with an opening of a tube and by subsequently operating the driving device for introducing the lance in the tube.

In order to further reduce the chances of accidents involving the high pressure liquid, it is known to couple the above mentioned cleaning device to a moving system for moving the cleaning device with respect to heat exchanger, such that manually operating the cleaning device is not longer needed. Such a moving system may for instance comprise a framework having a first set of beams onto which a perpendicularly oriented second beam can travel, for instance using a linear motor. The cleaning device can then travel, for instance also using a linear motor, on the second beam such that cleaning device is movable in a first direction and a second direction at least having a component perpendicular to the first direction. The motors for moving the cleaning device are remotely operable, such that the operator can operate the cleaning device from a safe distance.

SUMMARY

Although this known moving system improves the safety by allowing remotely operating the device, the inventors have discovered that this known moving system having a relatively large frame is less useful in situations with limited space, for instance when the heat exchanger is to be cleaned in situ, instead of in a dedicated cleaning location. Moreover, they note that moving the known moving system between locations, in particular between objects to be cleaned, is labor intensive, in particular due to the size of the system.

At least one embodiment is directed to providing an improved system for cleaning an object, in particular a heat exchanger, wherein at least one of the above mentioned problems is at least partially alleviated.

At least one embodiment is directed to a system. More specifically, at least one embodiment is directed to a system for cleaning an object, such as a heat exchanger comprising a bundle of feed-through tubes extending between two end plates, wherein the system comprises a connection body for connecting the system to an object, a holder for holding a cleaning device and a moving system for moving the holder with respect to the connection body in a first direction and a second direction at least having a component perpendicular to the first direction, wherein the moving system comprises a rotation motor and a linear motor.

BRIEF DESCRIPTION OF THE DRAWINGS

The present invention is further illustrated by the following Figures, which show an example embodiment of the system according to the invention, and are not intended to limit the scope of the invention in any way, wherein.

DETAILED DESCRIPTION OF THE EXAMPLE EMBODIMENTS

Figure 1:
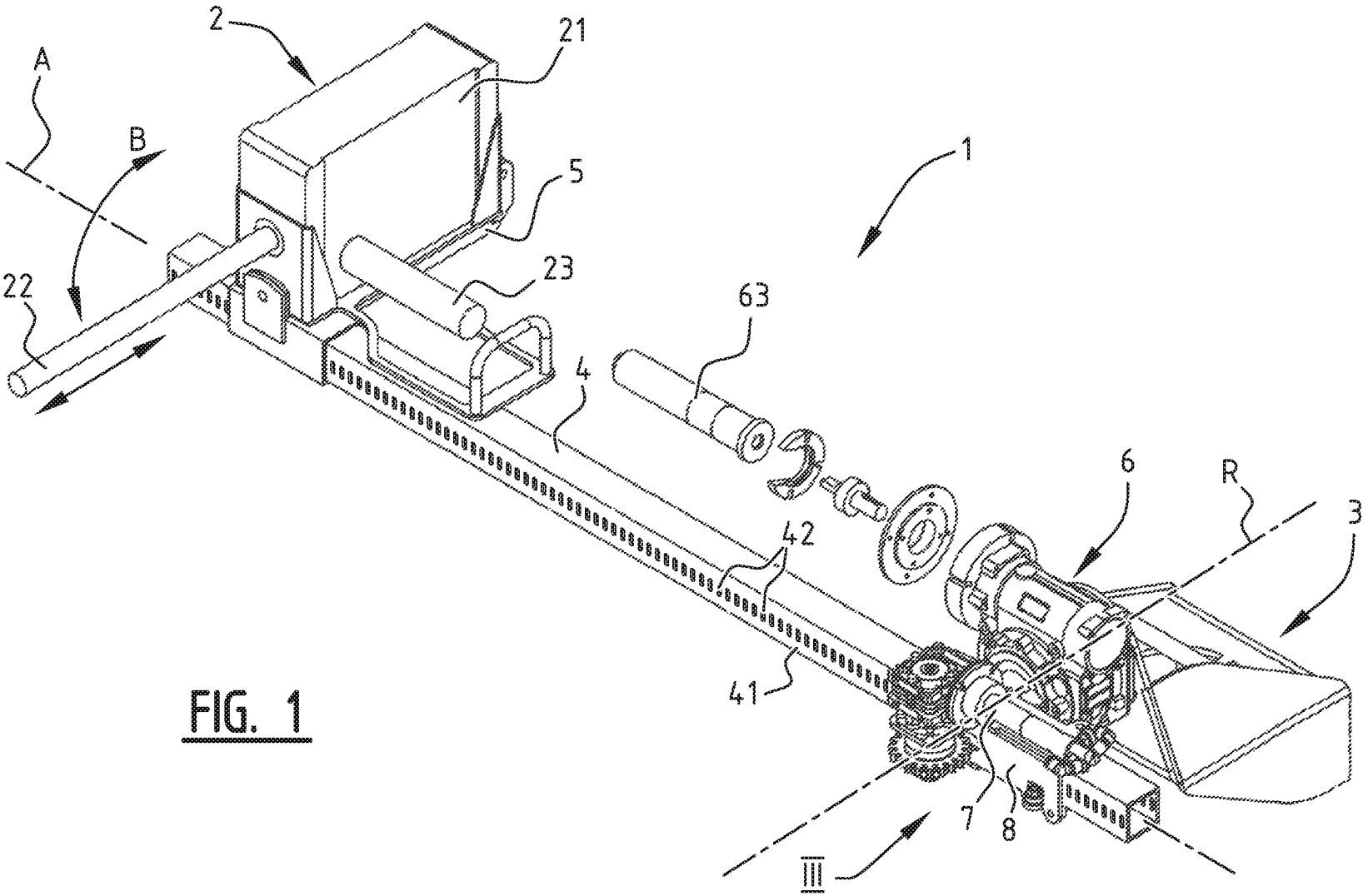
FIG. 1 shows the system in perspective view.

At least one embodiment is directed to a system. More specifically, at least one embodiment is directed to a system for cleaning an object, such as a heat exchanger comprising a bundle of feed-through tubes extending between two end plates, wherein the system comprises a connection body for connecting the system to an object, a holder for holding a cleaning device and a moving system for moving the holder with respect to the connection body in a first direction and a second direction at least having a component perpendicular to the first direction, wherein the moving system comprises a rotation motor and a linear motor.

By using a rotation motor in combination with a linear motor for moving the holder, and therewith the cleaning device, a relatively compact moving system is obtained. This makes the system according to at least one embodiment of the invention in particular useful for cleaning heat exchangers in situ.

In an example embodiment, the system is provided with one linear motor and one rotation motor only to actively move the holder and therewith the cleaning device. In other words, the holder in the moving system is actively moved in the first and second directions with respect to the object to be cleaned by only one rotation motor and one linear motor.

The connection body, or connecting device, is preferably arranged to stably hold and support the driving system by coupling the system to a stable environment. Although it is possible that the moving system according to the invention can be coupled to any suitable member associated with or located near the object to be cleaned, it is preferred if the connection body is arranged to be coupled to the object to be cleaned itself. Any further support members, for instance in the form of frames and the like, are then not required for operating the system.

According to a further example embodiment, the connection body is arranged to be coupled to the flange of a heat exchanger. This efficiently aligns the system with the heat exchanger to be cleaned. The connection body may be coupled to the flange, or any other part of the heat exchanger, for instance using a clamp for clamping around the flange, but it is preferred if the connection body is provided with a coupling plate with at least two openings for receiving bolts for coupling to the heat exchanger flange. The openings in the flange which are in use of the heat exchanger used for connecting an end plate, can thus be used for connecting the system according to the invention to the heat exchanger. In order to be able to connect to different types and sizes of heat exchangers, having different configurations of the openings in the flanges, it is preferred if the coupling plate is provided with a plurality of openings and/or wherein at least one of the openings is slot shaped.

The holder is arranged to hold a cleaning device, preferably a cleaning device arranged to drive a flexible lance for cleaning a heat exchanger duct or the like, provided with a frame in which a device to drive a flexible lance is arranged for moving this flexible lance in the direction of an outlet opening. An example of such a device is described in WO 01/11303A1, the entire contents of which are hereby incorporated herein by reference. The holder is thereto preferably provided with a receptacle shaped to receive the above mentioned frame or any outer housing, wherein the holder is further provided with a coupling, or coupling device, for coupling the cleaning device to the holder. The coupling may for instance comprise a clamp or any suitable connection for preferably removably coupling the cleaning device to the holder. A further example embodiment according to the invention further comprises a cleaning device, preferably a cleaning device of the above mentioned type, coupled to the holder.

It is noted that also other cleaning devices than the type mentioned above may be coupled to the holder. It is for instance possible to couple a cleaning device having a nozzle for cleaning the end plate, i.e. the structure between the ends of the tubes, of a heat exchanger. It may further be possible that the holder is arranged to couple and hold only a guiding tube for a lance, wherein the guiding tube extends between an externally located cleaning device provided with the driving device as mentioned above and the holder of the system according to the invention.

A further example embodiment of the system according to the invention further comprises a supporting arm for supporting the holder. The supporting arm hereby preferably has a suitable length such that the holder can be aligned with any of the tubes in a heat exchanger. Preferably, the rotation motor is arranged to rotate the supporting arm with respect to the connection device. The supporting arm and the holder are then movable with respect to the connection body, and thereby with respect to the object to the cleaned. It is preferred in terms of compactness if the system according to an example embodiment of the invention is provided with one supporting arm only.

According to further preferred embodiment, the linear motor is arranged to move the holder in a plane perpendicular to the rotation axis of the rotation motor. The combination of the linear motor and the rotation motor thereby allows moving the holder in the plane, thereby efficiently moving the holder in the first and second direction while still allowing a compact configuration. Preferably the plane is substantially parallel to the plane or surface of the object to the cleaned. Specifically, the plane is preferably substantially parallel to the end plate wherein the to be cleaned tubes of a heat exchanger end. A particularly compact and efficient driving system is obtained if the linear motor is arranged to move the holder in a radial direction with respect to the rotation axis of the rotation motor.

According to a further preferred embodiment, the rotation motor is provided on the connection body. The rotation motor hereby rotates the supporting arm with respect to the connection body, wherein the rotation motor preferably interconnects the connection body and the supporting arm, such that only a single supporting arm is required. It is hereby preferred if the connection body and the rotation motor are arranged such that in connected state on a heat exchanger, the rotation axis of the rotation motor is substantially parallel to the tubes to be cleaned, i.e. perpendicular to the end surface of the object to be cleaned.

In order to be able to efficiently decouple the system according to at least one embodiment of the invention from an object to be cleaned to move and couple the system to the next object to be cleaned, it is preferred if the rotation motor comprises a removable rotation axle for decoupling the supporting arm and the connection body upon removal of the rotation axle. The rotation axle and the housing of the rotation motor are hereby removable from each other, such that upon decoupling of the axle, the connection body and the supporting arm are also decoupled. The connection body and the supporting arm can then be transported separately. It is hereby preferred if the housing of the rotation motor is provided on the connection body, whereas the rotation axle of the rotation motor is associated, preferably coupled, with the supporting arm.

According to a further preferred embodiment, the linear motor comprises a rack and pinion or similar system. The supporting arm may for instance be provided with a rack, for instance a wall provided with a plurality of openings thereby forming a rack, wherein a pinion engages for moving the holder.

Although it is possible that the holder is moved along the supporting arm, i.e. along its longitudinal axis, it is preferred if, according to a further preferred embodiment, the holder is coupled to the supporting arm and wherein the linear motor is arranged to move the supporting arm with respect to the connection body. The combination of the supporting arm and the holder coupled thereto is thus moved with respect to the connection body. The linear motor can hereby be located close to the connection body, where also the rotation motor is preferably arranged as mentioned above. This results in a compact and robust configuration.

To however still be able to adjust the configuration of the holder and the supporting arm to the environment, it is preferred if the holder is removably coupled to the supporting arm for moving the holder along the longitudinal axis of the supporting arm. The holder is hereby preferably manually, thus not actively using a motor, movable along the supporting arm. The holder may for instance be provided with a clamp for clamping the supporting arm. It is further possible that the holder is provided with a connection system which cooperates with the rack-like structure on the supporting arm for mutually interconnecting the holder and the supporting arm. In case the wall of the supporting arm is provided with a plurality of openings along the length as mentioned above, the connection system may for instance comprise a pin which locks in at least one of the openings.

In case the linear motor is arranged to move the combination of the supporting arm and the holder with respect to the connection body a mentioned above, it is preferred if the system further comprises a sleeve for receiving the supporting arm, wherein the linear motor is arranged to move the supporting arm within the sleeve. The sleeve hereby closely receives and guides the supporting arm, such that the relative movement between the sleeve and supporting arm is substantially limited to a movement along one direction, preferably along the longitudinal axis of the supporting arm. The sleeve or tube hereto preferably has an inner cross sectional shape which corresponds to the cross sectional shape of the supporting arm. The cross section is preferably non-circular to prevent mutual rotation.

In case a removable rotation axle is used as mentioned above, it is preferred if the rotation axle is coupled to the sleeve. A robust configuration is hereby obtained which can be assembled and disassembled efficiently.

As the system according to at least one embodiment of the invention is particularly suitable to clean a heat exchanger in situ, i.e. without removing the heat exchanger from its surroundings, electric components are to be avoided. Therefore, according to a preferred embodiment, the motors comprise pneumatic motors. It is further preferred if the linear and rotation motors comprise the same type of pneumatic motors. The motors are then coupled using suitable transmission device(s). Also the motor of the cleaning device is preferably of the same kind as the motors of the linear and rotation motor.

A further preferred embodiment of the system according to the invention further comprises a controller for remotely controlling at least the motors and preferably also a cleaning device held in the holder. The controller is then coupled to the motors and is provided with suitable controller(s) for controlling the operation of the motor. Preferably the controller is coupled to the motors using pneumatic lines.

In FIG. 1, a system 1 for cleaning a heat exchanger according to an embodiment of the invention is shown. The system 1 is provided with a connection body 3, a supporting arm 4 and a holder 5 onto which a cleaning device 2 is held. The supporting arm 4 is rotatable with respect to the connecting body 3 using a rotation motor 6. The supporting arm 4 with the holder 5 coupled thereto is further movable with respect the connection body 3 using a linear motor 7. The linear motor 7 is hereby arranged to move the cleaning device 2 in the longitudinal direction A of the supporting arm 4 and the rotation motor 6 is arranged to move the cleaning device 2 is a direction substantially perpendicular to this direction A by rotation along rotation axis R, schematically indicated with the double arrow B in FIG. 1.

Figure 2:
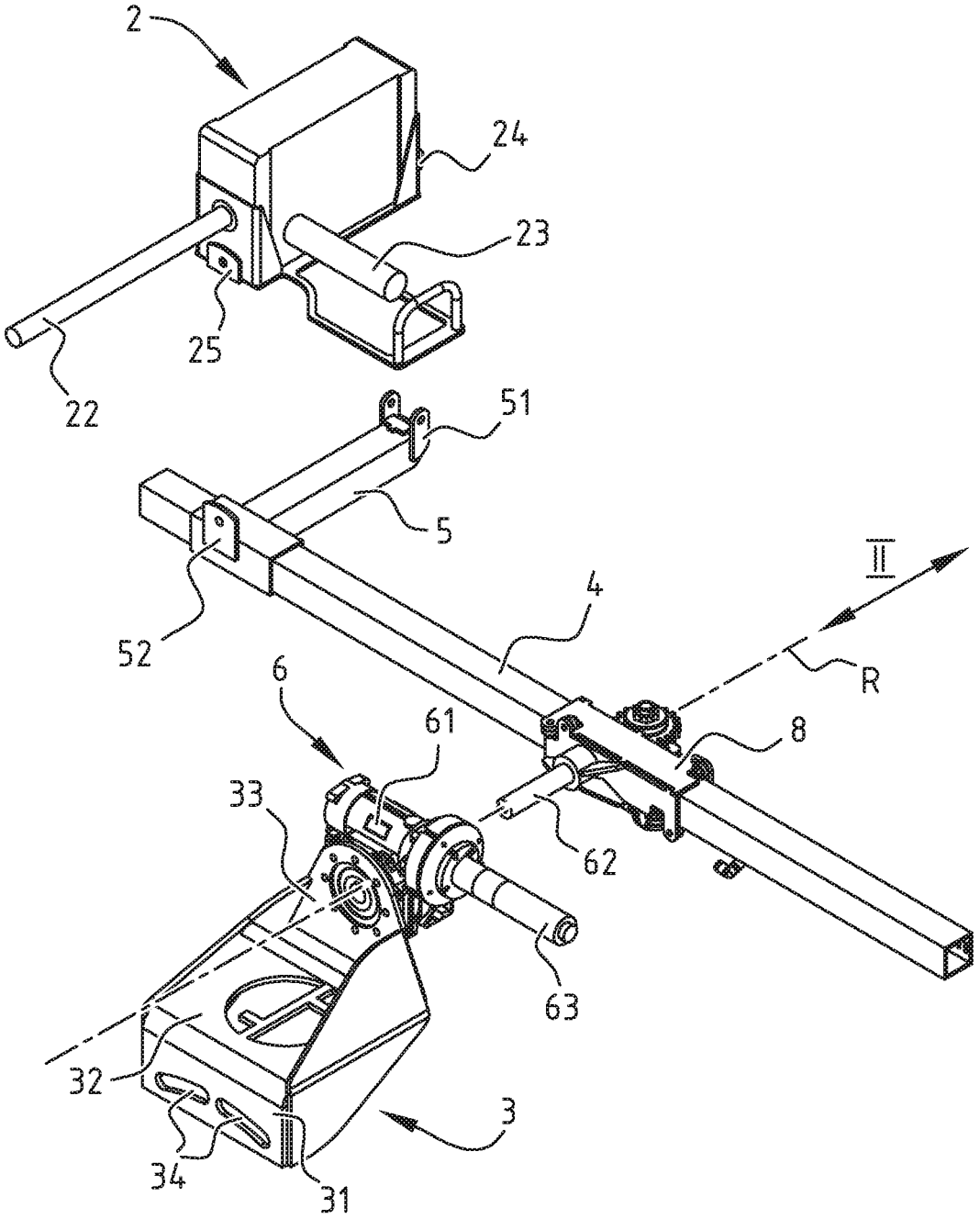
FIG. 2 shows the system in disassembled configuration.

Further referring to FIG. 2, it is noted that the orientation of the cleaning device 2 is different in the FIGS. 1 and 2 to indicate that with the system according to an embodiment of the invention, a versatile system is provided. It is noted that also different devices than the cleaning device 2 for feeding a cleaning lance can be connected to the holder 5.

Also the connection body 3 is in greater detail shown in FIG. 2. The connection body or connection device 3 is provided with a connection plate 31 wherein two slot shaped openings 34 are provided. The openings 34 are used to connect the connection body 3 to a flange of a heat exchanger by inserting bolts through the openings 34 and the respective openings in the flange. Via a connecting structure 32, the connection plate 31 is connected to a support plate 33 onto which the rotation motor 6 is supported. The connection device 3 is hereby arranged such that the rotation axis R of the rotation motor 6 extends perpendicular to the plane of the connection plate 31, such that the rotation axis R will be substantially parallel to the longitudinal axis of the heat exchanger to be cleaned. The rotation motor 6 comprises a motor housing 61 which is coupled to the support plate 33. A pneumatic motor 63 is coupled via suitable transmission device to the motor housing 61.

The rotation axle 62 of the rotation motor 6 can be decoupled from the motor housing 61 such that the axle can be moved in a direction of the rotation axis R, indicated with arrows II in FIG. 2. The axle 62 is interconnected with the supporting arm 4, in this example via sleeve 8 as will be explained in greater detail below, such that the supporting arm 4 and the connection device 3 can be decoupled by removing the rotation axle 62 from the rotation motor 6. Actuation of the rotation motor 6 rotates the supporting arm 4 with respect to connection body 3 along the rotation axis R.

Figure 3:
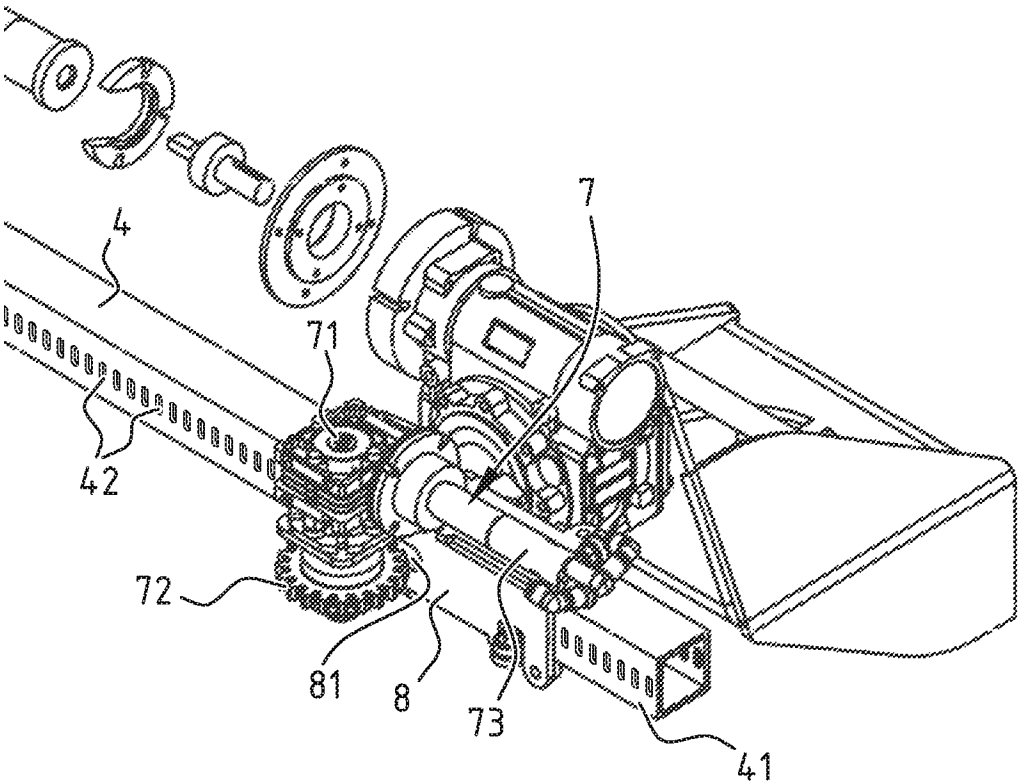
FIG. 3 is a detail of FIG. 1.

Also with reference to FIG. 3, the linear motor 7 is in this embodiment in the form of a rack and pinion system, wherein a wall 41 of the supporting arm 4 is provided with a plurality of slots 42 along its length wherein a pinion 72 of the linear motor 7 engages for moving the arm 4. The linear motor 7 is connected and supported to a sleeve 8 which has a tube like body for receiving the supporting arm 4. The cross section of the arm 4 and the sleeve 8 thereby correspond such that any relative movement between the arm 4 and the sleeve 8 is limited along the longitudinal axis A of the arm 4. The sleeve 8 is provided with a slot 81 through which the pinion 72 extends such that the pinion 72 can engage the openings 42 in the wall 41 of the arm 4. The pinion 72 is connected to a pneumatic motor 73 via a suitable transmission 71. Actuation of the pneumatic motor 73 will thus rotate the pinion 72, thereby translating the arm 4 within sleeve 8 which is in this example rigidly coupled to the axle 62.

Provided near an outer end of the supporting arm 4 is a holder 5 which is arranged to couple to a cleaning device 2, see FIGS. 1 and 2. Cleaning device 2 is provided with a housing 21 wherein lance driving device(s) are arranged which are arranged to move a high pressure lance in and out of an outlet opening 22 of the device 2. The driving device(s) are operated by a pneumatic motor 23. In order to be able to replace the cleaning device 2 with another device, for instance another type of cleaning device, the holder is provided with locking devices 51, 52 for removably interlocking the cleaning device 2 onto the holder 5. In this example, two space apart connection rings 51 are arranged to receive a ring 24 of the cleaning device 2 such that a pin can be received through rings 51 and 24. A connection plate 52 is further provided with an opening which is to coincide with an opening 25 of the cleaning device 2 to receive a connection pin there through.

The operation of the system 1 will now be explained while referring to FIGS. 4*a-d*. In these figures, the system 1 is seen to be coupled to a heat exchanger 100. The tube heat exchanger 100 as shown consists substantially of a bundle of tubes, only a few of which are indicated with 101, extending between two end plates of which one end plate 104 is visible. A flange 102 protrudes from the end of the heat exchanger 100 in which a plurality of openings 103 are provided. Two of the openings 103 are used to connect the connection plate 31 of the connection body 3 to the flange 102 by aligning the slots 34 with the two openings 103 of the flange 102 and by inserting bolts therein.

In the connected situation, the outlet 22 of the cleaning device 2 is arranged to be aligned such that a lance can be inserted substantially parallel into the tubes 101. The system 1 is hereby arranged to move the cleaning device 2 in a plane parallel to the end plate 104 such that the outlet 22 can be aligned with each of the tubes 101 for cleaning. Actuation of the linear motor 7 will hereby move the arm 4 with respect to the connection body 3, such that the cleaning device 2 is moved in a direction along the longitudinal direction A indicated with the arrows C. This movement can be seen when comparing FIGS. 4*a* and 4*b*. Actuation of the rotation motor 6 will move the cleaning device 2 in directions indicated with the arrows B in FIG. 4*a*. A clockwise movement of the cleaning device 2 can be seen when comparing FIGS. 4*a* and 4*c*. The combination of the linear motor 7 and the rotation motor 6 allows the cleaning device 2 to be moved over the whole surface 104 of the heat exchanger 100.

Figure 4A:
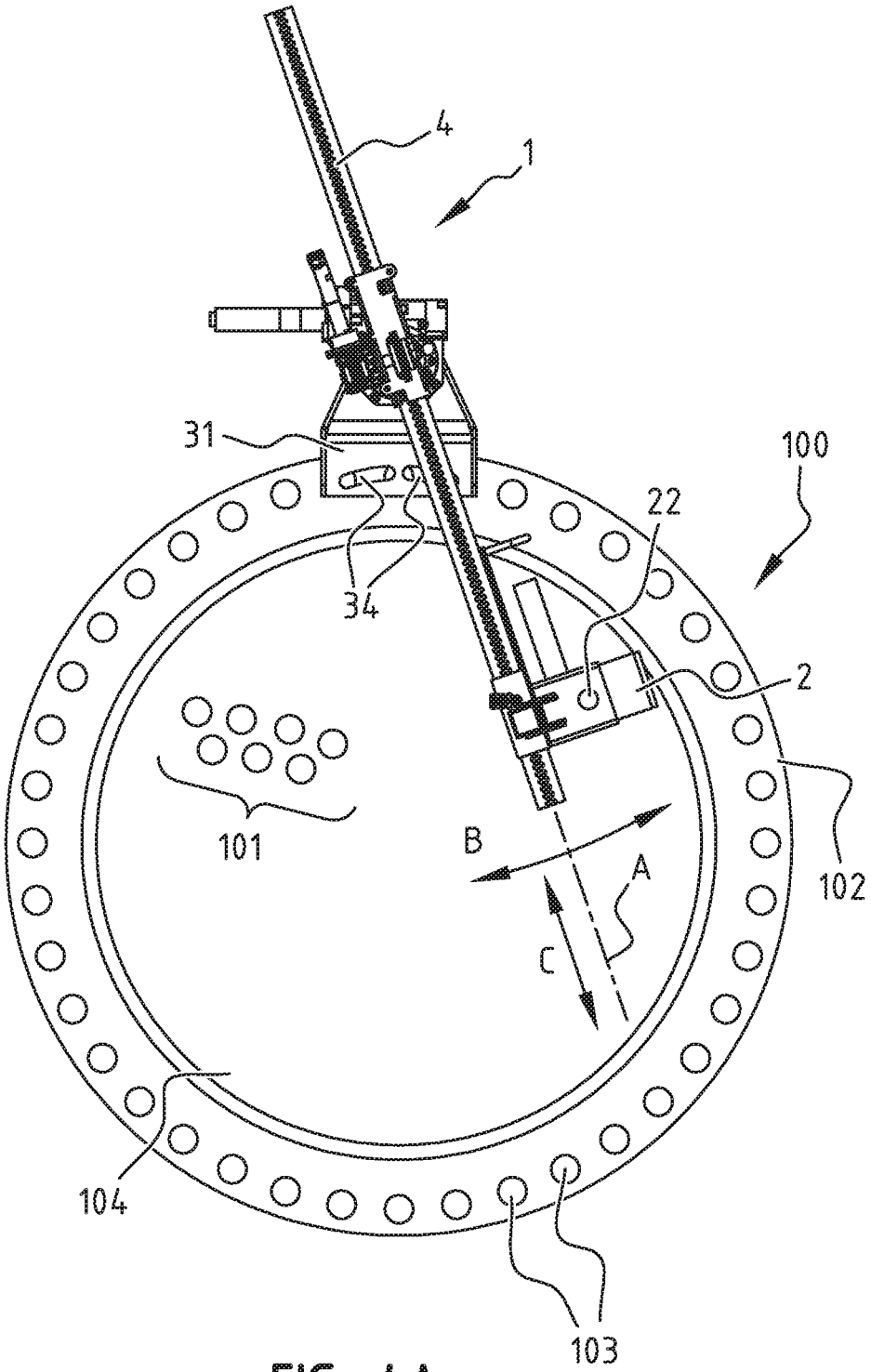
FIGS. 4*a-d* show the system on a heat exchanger in different positions.
Figure 4B:
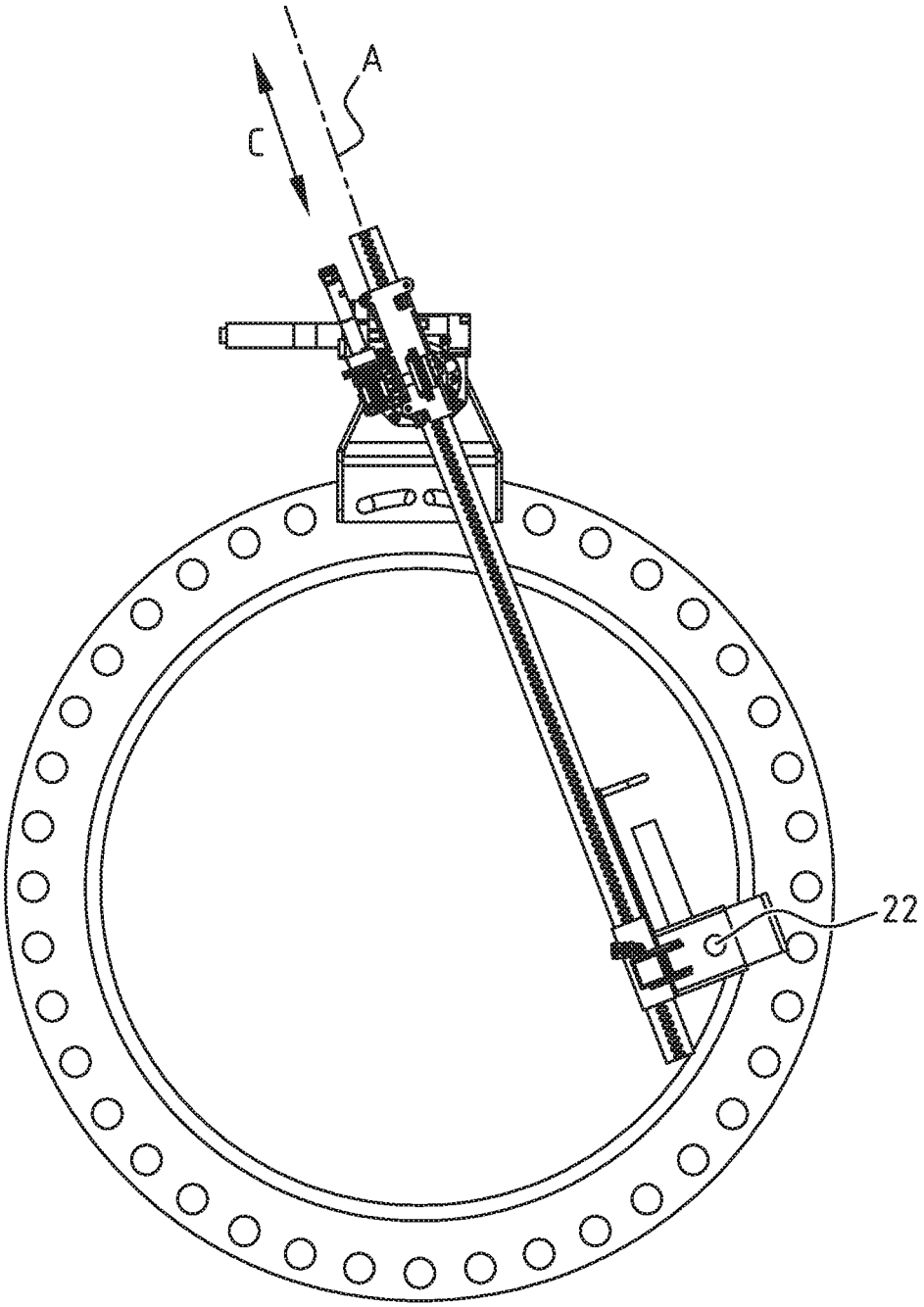
Figure 4C:
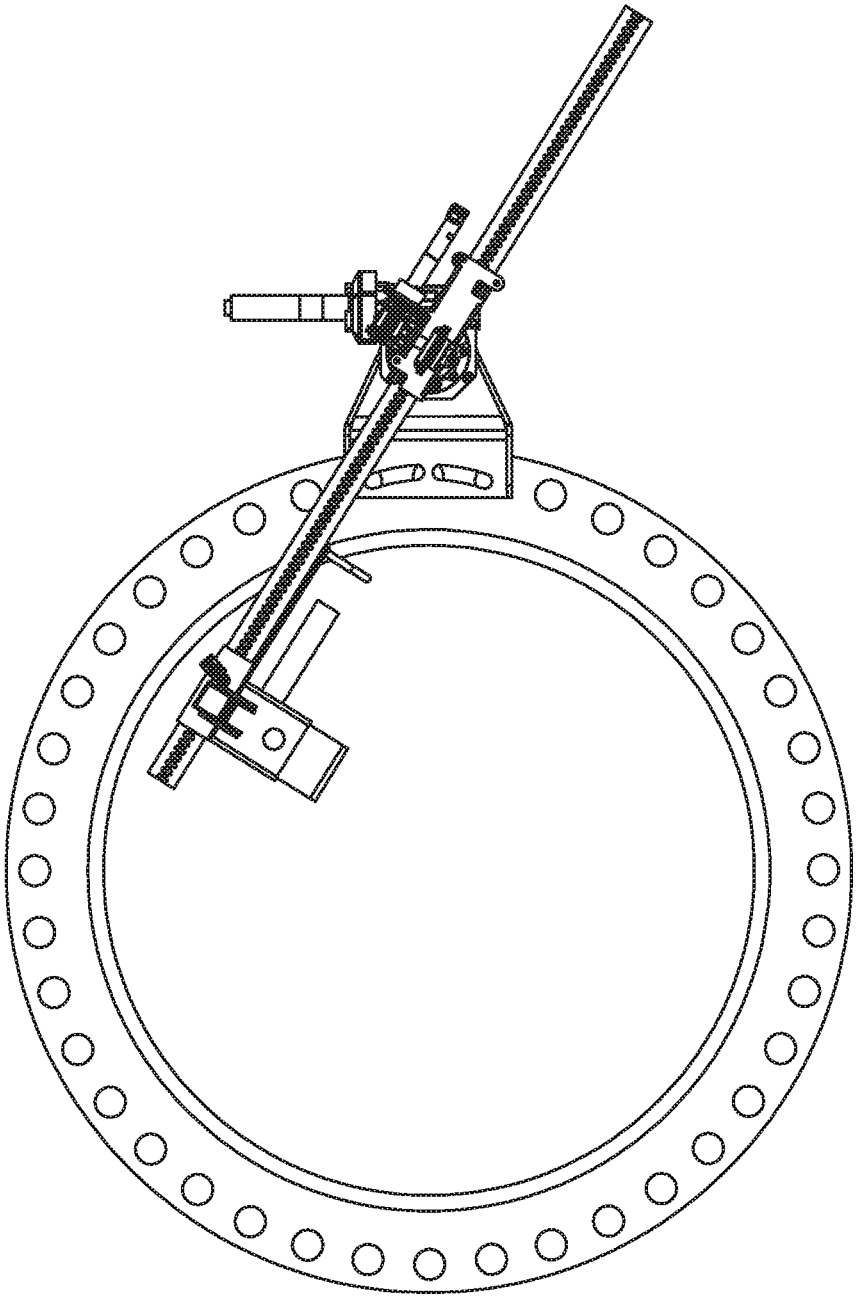
Figure 4D:
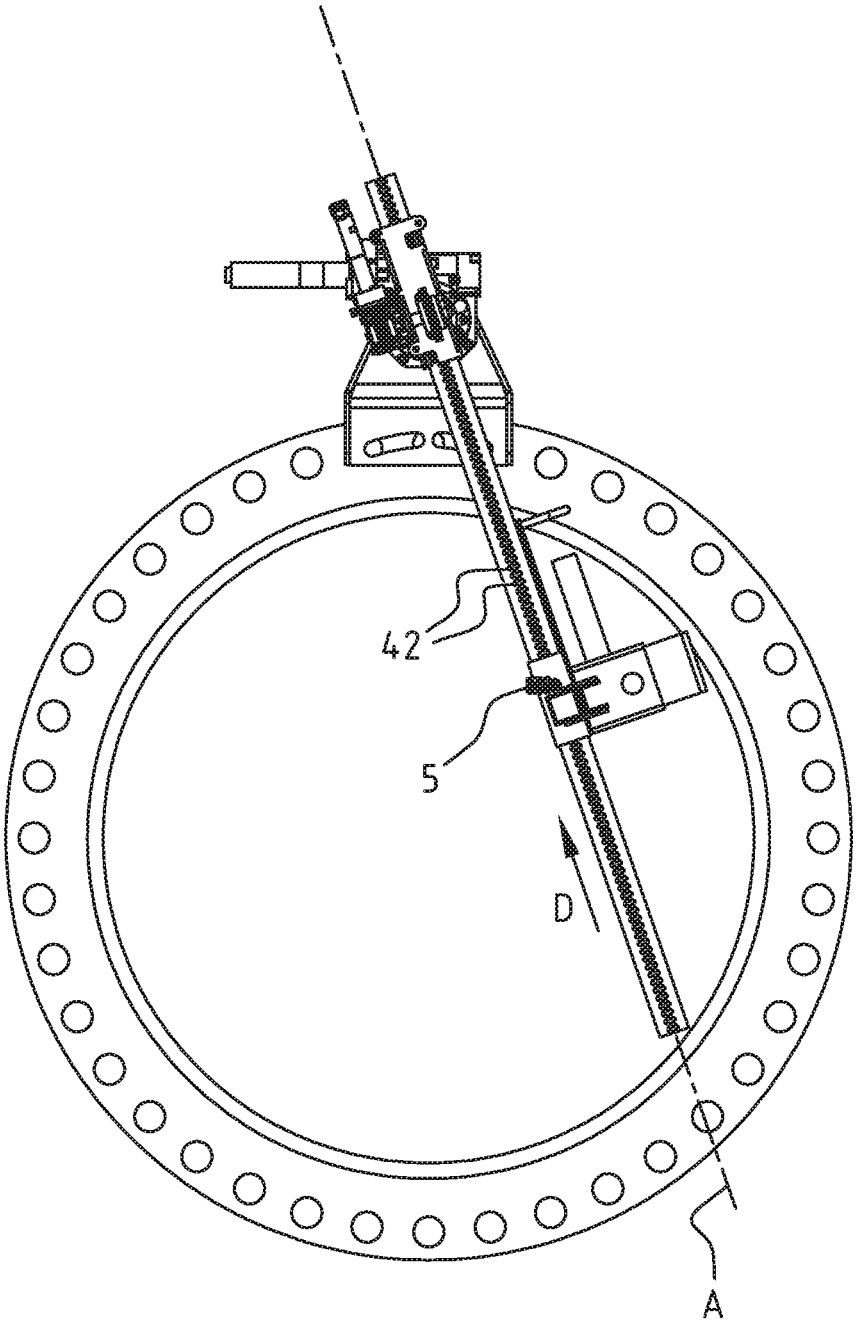

With reference to FIG. 4*d*, it can be seen that the holder 5 is manually movable along the arm 4, indicated with the arrow D. The holder 5 is in this example provided with slots which are to be aligned with openings 42 of the arm 4 such that by inserting a pins in the slots, the holder 5 is locked with respect to the arm 4. Movement of the holder 5 along the arm 4 is useful for situations where space is limited.

The present invention is not limited to the embodiment shown, but extends also to other embodiments falling within the scope of the appended claims.

None of the elements recited in the claims are intended to be a means-plus-function element within the meaning of 35 U.S.C. §112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A system for cleaning a heat exchanger including a bundle of feed-through tubes extending between two end plates by injecting liquid under high pressure through the tubes using a high-pressure lance, wherein the system comprises:

a cleaning device arranged for driving a flexible lance adapted for cleaning the heat exchanger tubes, said cleaning device provided with a frame in which a mechanism for driving the flexible lance is arranged and which mechanism moves the flexible lance in a direction of an outlet opening of the cleaning device;

a connection body adapted to connect the system to the heat exchanger;

a holder for holding the cleaning device that is movable with respect to the connection body in a first direction and a second direction, wherein the second direction is perpendicular to the first direction;

a single rotation motor comprising a motor housing that is connected to the connection body and a motor coupled via a transmission device to the motor housing for driving a rotation axle of the rotation motor around a rotation axis;

a rotatable cantilever supporting arm for supporting the holder, wherein the rotatable cantilever supporting arm is coupled with the rotation axle of the rotation motor;

wherein the rotation motor interconnects the connecting body and the rotatable cantilever supporting arm and selectively rotates the rotatable cantilever supporting arm with respect to the connection body, wherein the rotatable cantilever supporting arm extends outwardly in a radial direction with respect to the rotation axis in a cantilevered manner;

wherein a single linear motor selectively moves the holder in a radial direction that is perpendicular to the rotation axis of the rotation axle of the rotation motor;

wherein the single linear motor comprises a rack and pinion assembly, wherein the rotatable cantilever supporting arm comprises a wall provided with a plurality of openings defined therein and forming the rack which is engaged by a pinion for moving the holder in the radial direction;

wherein the single linear motor and the single rotation motor are the only motors for moving the holder in the first direction and the second direction.

2. The system of claim 1, wherein the connection body is arranged to be connected to a flange of a heat exchanger, the connection body including a coupling plate including at least two slots for receiving bolts for coupling to the heat exchanger flange.

3. The system of claim 1, wherein the rotation axle is a removable rotation axle for decoupling the rotatable cantilever supporting arm and the connection body upon removal of the rotation axle.

4. The system of claim 3, wherein the removable rotation axle is coupled to a sleeve for receiving the rotatable cantilever supporting arm.

5. The system of claim 1, wherein the holder is removably coupled to the rotatable cantilever supporting arm for moving the holder along a longitudinal axis of the rotatable cantilever supporting arm.

6. The system of claim 1, further comprising a sleeve for receiving the rotatable cantilever supporting arm, wherein the single linear motor is arranged to move the rotatable cantilever supporting arm within the sleeve.

7. The system of claim 1, wherein the single rotation motor and the single linear motor are pneumatic motors.

8. The system of claim 1, further comprising a controller for removably controlling at least the single rotation motor and the single linear motor.

9. The system of claim 8, wherein the controller is further for remotely controlling the cleaning device held in the holder.

10. The system of claim 1, wherein the connection body is arranged to be connected to a flange of the heat exchanger.

11. The system of claim 1, wherein the holder includes at least one locking device, to removably lock the cleaning device onto the holder.

12. A system for cleaning a heat exchanger including a bundle of feed-through tubes extending between two end plates, wherein the system comprises:

a connection body for connecting the system to the heat exchanger; wherein the connection body is arranged to be coupled to a flange of the heat exchanger;

a holder adapted to hold a cleaning device;

a moving system for selectively moving the holder with respect to the connection body in one of a first direction and a second direction, wherein the second direction has at least a component perpendicular to the first direction, and wherein the moving system comprises a single rotation motor and a single linear motor, wherein the single linear motor and the single rotation motor are the only motors of the system for moving the holder in the first direction and the second direction; and a rotatable supporting arm supporting the holder;

wherein the single rotation motor e selectively rotates the rotatable supporting arm with respect to the connection body, and wherein the rotation motor interconnects the connecting body and the rotatable supporting arm;

wherein the single linear motor selectively moves the holder in a radial direction with respect to a rotation axis of the single rotation motor; and wherein the holder is coupled to the rotatable supporting arm and the single linear motor selectively moves the rotatable supporting arm with respect to the connection body as a whole in a linear direction along a longitudinal axis of the rotatable supporting arm.

13. The system of claim 12, wherein the connection body is arranged to be connected to a flange of the heat exchanger, the connection body including a coupling plate including at least two openings for receiving bolts for coupling to the heat exchanger flange, wherein at least one of the openings is slot-shaped.

14. The system of claim 12, wherein the holder includes at least one locking device to removably lock the cleaning device onto the holder.

15. The system of claim 12, further comprising a sleeve for receiving the rotatable supporting arm, wherein the single linear motor is arranged to move the rotatable supporting arm within the sleeve.

16. The system of claim 15, wherein the rotation motor comprises a removable rotation axle for decoupling the rotatable supporting arm and the connection body upon removal of the rotation axle, and wherein the removable rotation axle is coupled to the sleeve for receiving the rotatable supporting arm.

17. The system of claim 12, further comprising:

a cleaning device arranged for driving a flexible lance, said cleaning device being provided with a frame in which a means for driving the flexible lance is arranged for moving the flexible lance in a direction of an outlet opening device in the cleaning device; and wherein said holder holds the cleaning device.

18. A system for cleaning a heat exchanger comprising a bundle of feed-through tubes extending between two end plates by injecting liquid under high pressure through the tubes using a high-pressure lance, wherein the system comprises:

a cleaning device arranged for driving a flexible lance, said cleaning device being provided with a frame in which a means driving the flexible lance is arranged for moving the flexible lance in a direction of an outlet opening device in the cleaning device;

a connection body adapted to connect the system to the heat exchanger;

a holder for holding the cleaning device that is movable with respect to the connection body in a first direction and a second direction, wherein the second direction is perpendicular to the first direction, wherein the holder includes at least one locking device comprising a clamp to removably lock the cleaning device onto the holder, wherein the cleaning device is coupled to the holder;

a single rotation motor comprising a motor housing that is connected to the connection body and a motor coupled via a transmission device to the motor housing for driving a rotation axle of the single rotation motor around a rotation axis;

a rotatable cantilever supporting arm for supporting the holder, wherein the rotatable cantilever supporting arm is coupled with the rotation axle of the single rotation motor;

wherein the single rotation motor interconnects the connecting body and the rotatable supporting arm and selectively rotates the rotatable cantilever supporting arm with respect to the connection body, wherein the rotatable cantilever supporting arm extends outwardly in a radial direction with respect to the rotation axis in a cantilevered manner;

wherein a single linear motor is arranged to move the holder in a radial direction that is perpendicular to the rotation axis of the single rotation motor; and wherein the single linear motor and the single rotation motor are the only motors for moving the holder in the first direction and the second direction.

19. A system for cleaning a heat exchanger including a bundle of feed-through tubes extending between two end plates, wherein the system comprises:

a connection body for connecting the system to the heat exchanger; wherein the connection body is arranged to be coupled to a flange of the heat exchanger;

a holder adapted to hold a cleaning device;

a moving system for selectively moving the holder with respect to the connection body in one of a first direction and a second direction, wherein the second direction has at least a component perpendicular to the first direction, wherein the moving system comprises a single rotation motor and a single linear motor; and wherein the single linear motor and the single rotation motor are the only motors of the system for moving the holder in the first direction and the second direction; and a rotatable supporting arm supporting the holder;

wherein the single rotation motor selectively rotates the rotatable supporting arm with respect to the connection body, and wherein the single rotation motor interconnects the connecting body and the rotatable supporting arm;

wherein the single linear motor selectively moves the holder in a radial direction with respect to a rotation axis of the single rotation motor; and wherein the holder is movable along the rotatable supporting arm, and wherein the movement of the holder is along a longitudinal axis of the rotatable supporting arm.

20. The system of claim 19, wherein the connection body is arranged to be connected to a flange of the heat exchanger, wherein the connection body includes a coupling plate having at least two openings for receiving bolts for coupling to the heat exchanger flange, and wherein at least one of the openings is slot shaped.

* * * * *